US008336342B2

(12) United States Patent
Song et al.

(10) Patent No.: US 8,336,342 B2
(45) Date of Patent: Dec. 25, 2012

(54) CLOTHES REFRESHING APPARATUS

(75) Inventors: Jung-tae Song, Changwon-Si (KR); Hee-tae Lim, Changwon-Si (KR); Suk-yun Moon, Changwon-Si (KR); Ig Geun Kwon, Changwon-Si (KR); Heung-gi Kim, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 1077 days.

(21) Appl. No.: 12/081,037

(22) Filed: Apr. 9, 2008

(65) Prior Publication Data

US 2009/0072683 A1 Mar. 19, 2009

(30) Foreign Application Priority Data

Apr. 10, 2007 (KR) ..... 10-2007-0034991

(51) Int. Cl.
*D06F 17/00* (2006.01)
*D06F 21/00* (2006.01)
*D06F 21/04* (2006.01)

(52) U.S. Cl. ..... 68/196; 68/24; 68/58

(58) Field of Classification Search ..... 68/196, 68/140, 24, 58; 134/184, 198
See application file for complete search history.

(56) References Cited

U.S. PATENT DOCUMENTS

| | | | | |
|---|---|---|---|---|
| 3,498,089 | A * | 3/1970 | Beebe et al. | 68/139 |
| 2007/0044521 | A1 * | 3/2007 | Choi et al. | 68/140 |

FOREIGN PATENT DOCUMENTS

| | | | |
|---|---|---|---|
| DE | 2001-6977 | U1 | 12/2000 |
| GB | 2356638 | A | 5/2001 |
| JP | 58-008493 | | 1/1983 |
| KR | 2001-0094415 | | 11/2001 |
| KR | 2002-0056323 | | 7/2002 |
| KR | 10-2006-0085965 | | 7/2006 |

* cited by examiner

*Primary Examiner* — Alexander Markoff
(74) *Attorney, Agent, or Firm* — McKenna Long & Aldridge LLP

(57) ABSTRACT

A clothes refreshing apparatus is disclosed. The clothes refreshing apparatus includes a cabinet forming an external appearance, a drum which is installed in the cabinet and provides a space in which clothes are loaded and refreshed, a front panel which forms a front surface of the cabinet and has a loading port through which the clothes are loaded into the drum, and a door which is installed to open and close the loading port, wherein the door is formed to have a vertical length equal to or larger than a vertical length of side surfaces of the front panel.

3 Claims, 8 Drawing Sheets

CLOTHES REFRESHING APPARATUS

CROSS-REFERENCE TO RELATED APPLICATION

This application claims the benefit of Korean Patent Application No. 10-2007-34991, filed on Apr. 10, 2007, which is hereby incorporated by reference in its entirety as if fully set forth herein.

BACKGROUND OF THE INVENTION

1. Field of the Invention

The present invention relates to a clothes refreshing apparatus, and more particularly to a drum type clothes refreshing apparatus.

2. Discussion of the Related Art

Generally, clothes refreshing apparatuses include a washing machine, a dryer, a drying and washing machine, a steam dryer and the like. The washing machine is an apparatus which removes stains or dirt from the laundry by chemical decomposition action and mechanical impact action. The dryer is an apparatus which dries articles to be dried by supplying hot air thereto.

Recently, the drying and washing machine, which has both functions of the washing machine and the dryer, is widely used. The steam dryer is an apparatus which removes the creases or smell from the clothes or the like by alternately supplying steam and hot air to the clothes or the like.

The drum type clothes refreshing apparatus includes an inner tub which is rotated while being laid down. Since the drum type clothes refreshing apparatus can have a reduced length and a larger capacity compared to a clothes refreshing apparatus having an inner tub which is rotated while being stood up, the use of the drum type clothes refreshing apparatus is being increased.

In the drum type clothes refreshing apparatus, generally, a loading port is formed on the front surface of a cabinet to load the laundry therethrough and a door is installed at the loading port to open and close the loading port.

However, the conventional clothes refreshing apparatus has the following problems.

The capacity of the clothes refreshing apparatus is determined according to the size of a drum. When the size of the drum is determined, the size of the door is also determined. Consequently, a clothes refreshing apparatus having a small capacity includes a small-sized door. Thus, the clothes refreshing apparatus appears to be small.

Further, the small-sized door causes inconvenience to the user in checking the inside of the drum.

SUMMARY OF THE INVENTION

Accordingly, the present invention is directed to a clothes refreshing apparatus that substantially obviates one or more problems due to limitations and disadvantages of the related art.

An object of the present invention is to provide a clothes refreshing apparatus which appears to be large by increasing the size of a door.

Further, another object of the present invention is to provide a clothes refreshing apparatus having a door which appears to be larger than any other door of the same size and enabling a user to easily check the inside of a drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a clothes refreshing apparatus includes a cabinet forming an external appearance; a drum which is installed in the cabinet and provides a space in which clothes are loaded and refreshed; a front panel which forms a front surface of the cabinet and has a loading port through which the clothes are loaded into the drum; and a door which is installed to open and close the loading port, wherein the door is formed to have a vertical length equal to or larger than a vertical length of side surfaces of the front panel.

In another aspect of the present invention, a clothes refreshing apparatus includes a cabinet which forms an external appearance and has a loading port formed on its front surface to load clothes; a drum which is installed in the cabinet and provides a space in which the clothes loaded through the loading port are refreshed; a door which is installed to selectively open and close the loading port; a tub which is installed in the cabinet to cover the drum; and a gasket which connects the tub to the door, wherein a cross-section of the gasket at a position connected to the door is formed to be larger than a cross-section of the gasket at a position connected to the tub.

In a further aspect of the present invention, a clothes refreshing apparatus includes a cabinet which forms an external appearance and has a loading port formed on its front surface to load clothes; a drum which is installed in the cabinet and provides a space in which the clothes loaded through the loading port are refreshed; and a door which is installed to selectively open and close the loading port, wherein an opening is formed at a central portion of the door, and an upper surface and a lower surface of the opening are formed to have different inclination angles.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a drum washing machine, serving as one example of a clothes refreshing apparatus, according to the present invention will be described in detail with reference to the accompanying drawings.

Although the drum washing machine is explained in this embodiment, the present invention may be also applied to other clothes refreshing apparatuses such as a drum type dryer, a drum type drying and washing machine and a drum type steam dryer.

The drum type dryer and the drum type drying and washing machine may include a heater which supplies hot air into a drum. The drum type steam dryer may include a steam generator which supplies steam into the drum in addition to the heater.

Further, a term 'clothes' used in the following description includes all articles capable of being washed and dried as well as general clothes.

Figure 1:
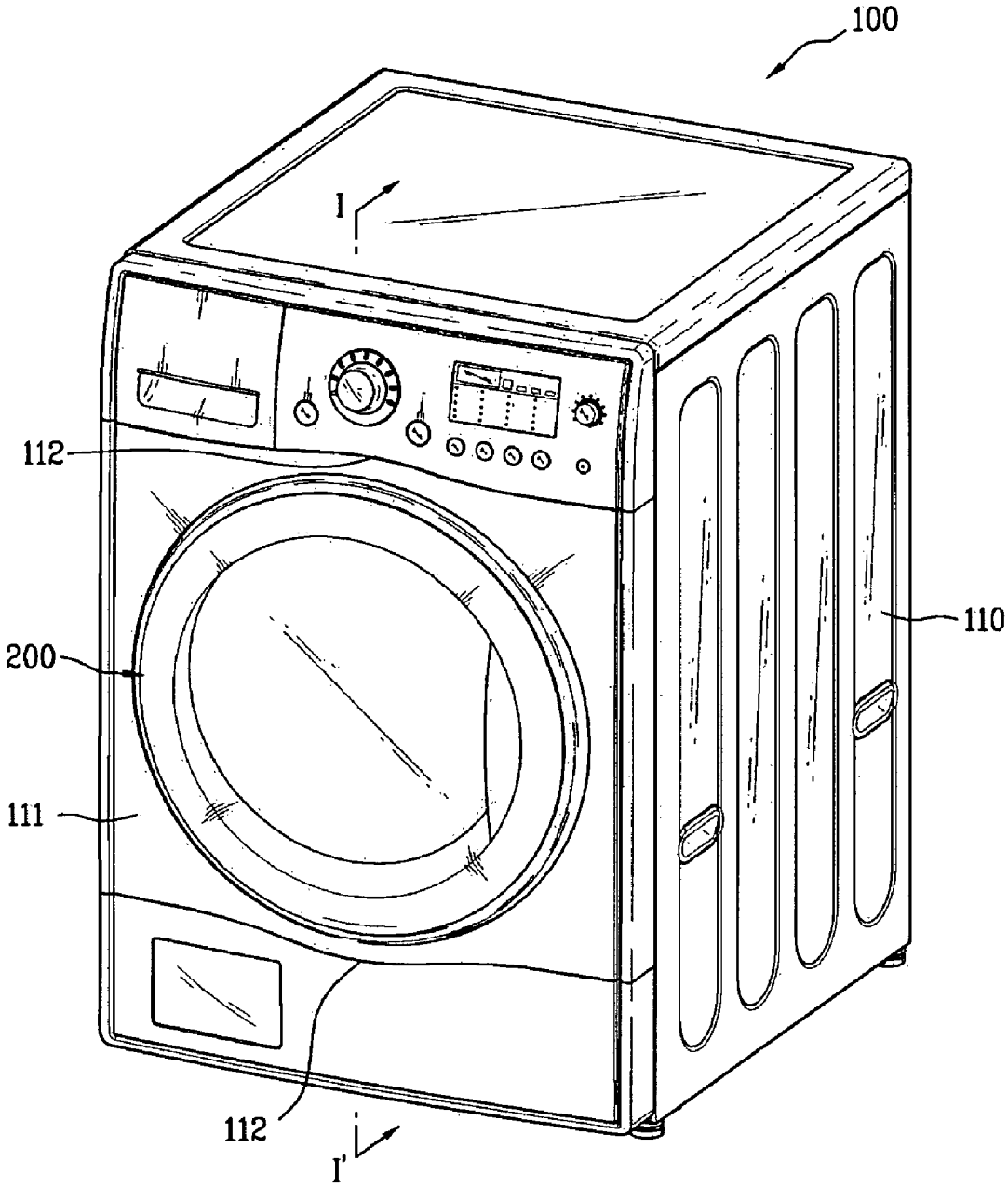
FIG. 1 illustrates a drum washing machine according to an embodiment of the present invention.
Figure 2:
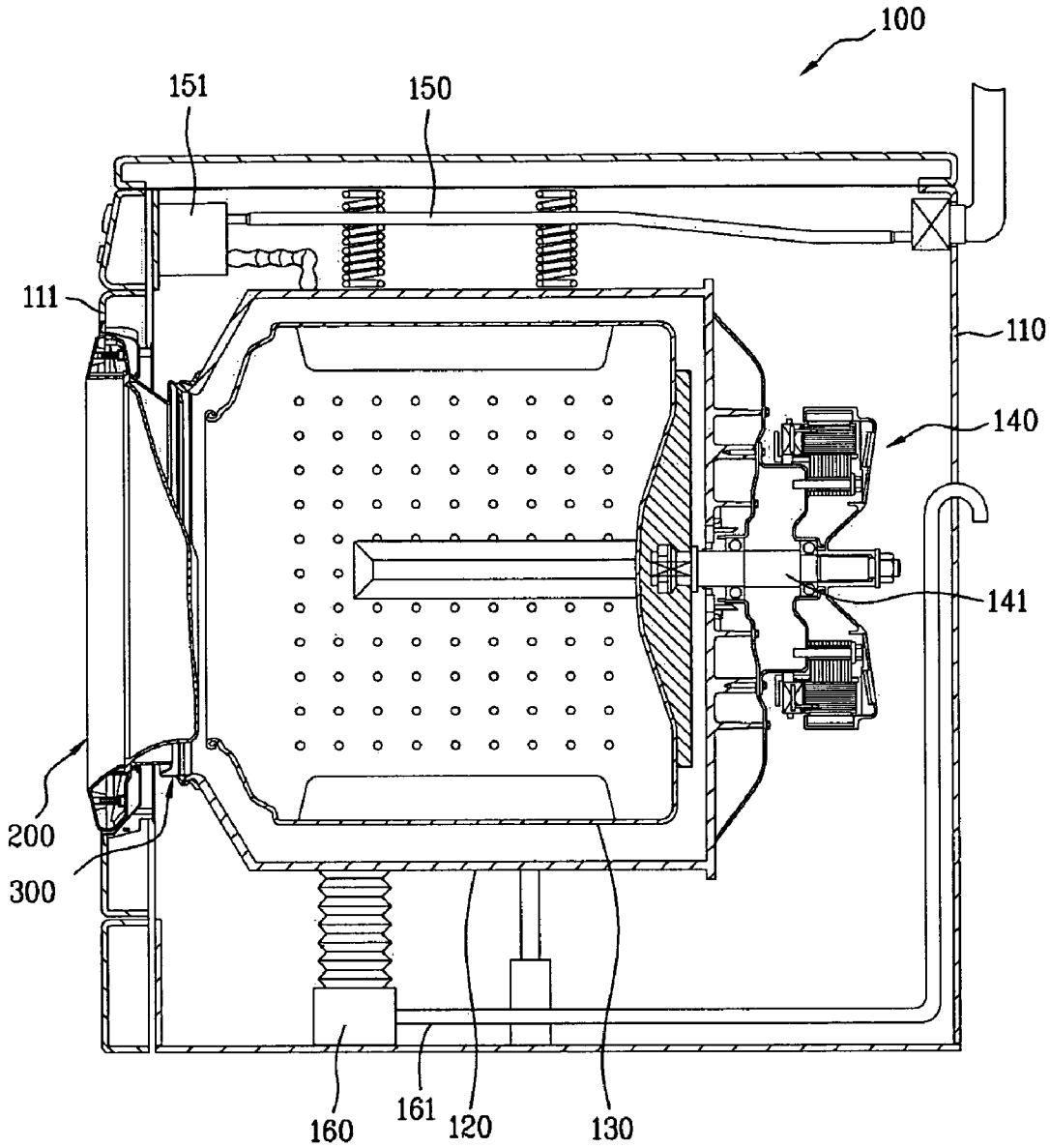
FIG. 2 illustrates a cross-sectional view taken along a line I-I' of FIG. 1.

FIG. 1 illustrates a perspective view of a drum washing machine according to an embodiment of the present invention. FIG. 2 illustrates a cross-sectional view taken along a line I-I' of FIG. 1.

Referring to FIGS. 1 and 2, a drum washing machine 100 according to the embodiment of the present invention includes a cabinet 110 forming an external appearance, a front panel 111 which forms the front surface of the cabinet 110 and has a loading port through which clothes are loaded and unloaded, and a door 200 which is installed to selectively open and close the loading port.

Further, the drum washing machine 100 includes a tub 120 which is installed in the cabinet 110 to store washing water in a washing operation and a drum 130 which is rotatably installed in the tub 120 and provides a washing space for washing the laundry loaded through the loading port. That is, the tub 120 is installed in the cabinet 110 to cover the drum 130.

Although the drum 130 of the drum washing machine 100 according to the embodiment of the present invention provides a space in which the laundry is loaded and washed, the drum of the dryer according to another embodiment provides a space in which the clothes are loaded and dried. That is, the drum 130 of the clothes refreshing apparatus according to the embodiment of the present invention provides a space in which the clothes are loaded and refreshed.

Further, the drum washing machine 100 includes a gasket 300 which connects the door 200 and the tub 120, a driving unit 140 which selectively rotates the drum 130 forward and backward, and a rotation shaft 141 which transfers a rotational force of the driving unit 140 to the drum 130.

The drum washing machine 100 may further include a water supply line 150 and a detergent supply unit 151 which respectively supply washing water and a detergent into the tub 120, and a drain pump 160 and a drain line 161 which discharge washing water contained in the tub 120 to the outside of the cabinet 110.

The above-configured drum washing machine 100 performs a washing operation while rotating the drum 130 by operating the driving unit 140 such that the laundry is lifted up and then drops due to gravity.

Figure 3:
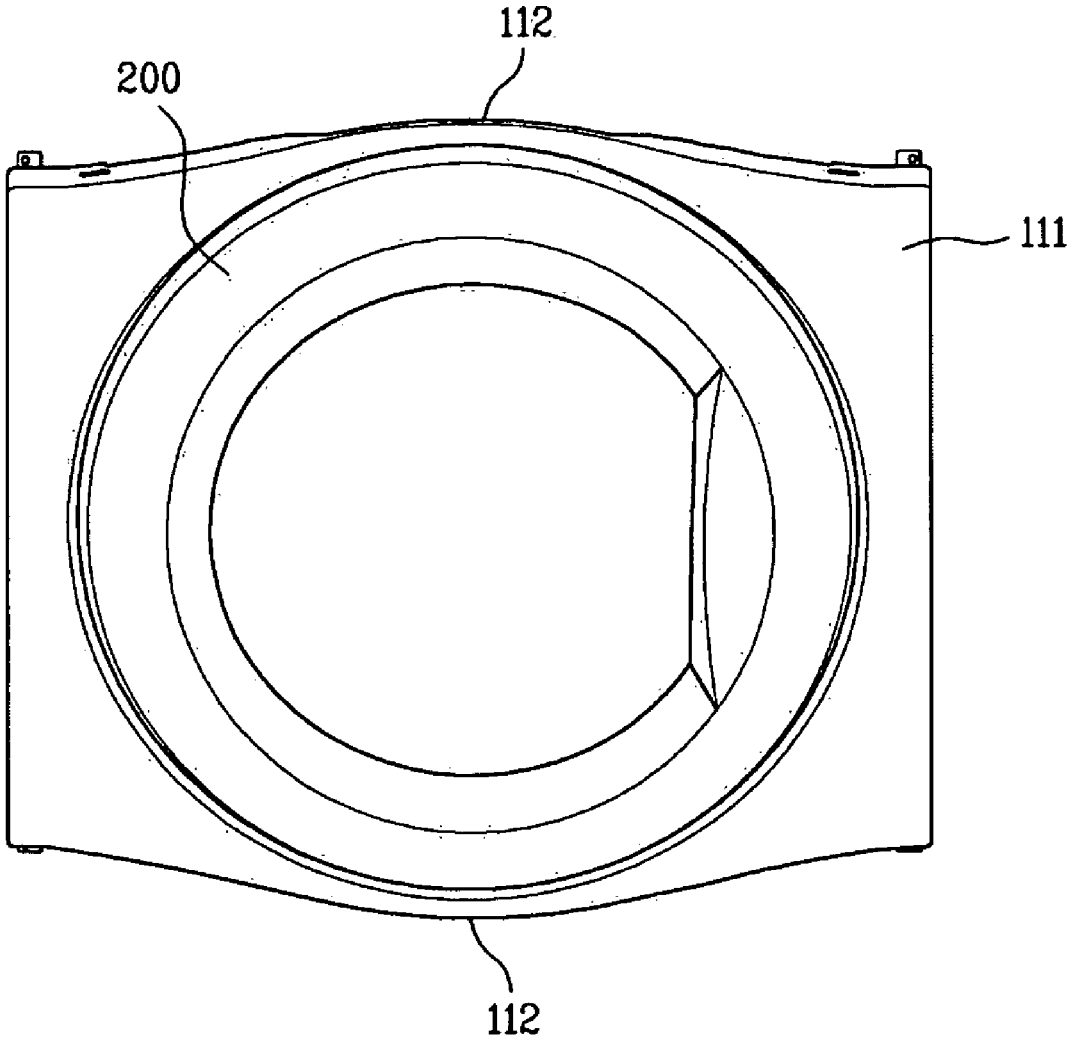
FIG. 3 illustrates a front view of a front panel and a door, the door being closed in the drum washing machine according to the present invention.

FIG. 3 illustrates a front view of the front panel and the door coupled to each other in the drum washing machine according to the present invention.

Referring to FIG. 3, the door 200 according to the present invention may be formed to have a vertical length equal to or larger than a vertical length of the side surfaces of the front panel 111. Further, a protruding portion 112 which is protruded upward or downward may be formed on at least one side of an upper central portion and a lower central portion of the front panel 111.

Generally, the capacity of the drum washing machine 100 is determined according to the size of the tub 130. The size of the tub 130 is determined according to the capacity of the drum washing machine 100, thereby also determining the size of the front panel 111 and the door 200.

Specifically, when the size of the tub 130 is determined, the size of the front panel 111 and the size of the loading port formed on the front panel 111 are determined corresponding to the size of the tub 130. Accordingly, the door 200, which is installed to selectively open and close the loading port of the front panel 111 is also determined corresponding thereto.

Thus, generally, drum washing machines having tubs of the same size include front panels of almost the same size and doors of almost the same size.

However, as shown in FIG. 3, the door 200 according to the present invention may be formed to have a vertical length equal to or larger than a vertical length of the side surfaces of the front panel 111.

Accordingly, the drum washing machine 100 of the present invention can include the door 200 having a quite larger size than a door of any other drum washing machine having the same capacity. Thus, the user can more easily check the inside of the drum 130 through the door 200.

The user prefers the drum washing machine 100 having a large capacity. Also, even when the user uses the drum washing machine 100 having a small capacity due to space or price restrictions, the user prefers the drum washing machine 100 which appears to be larger. Thus, the drum washing machine 100 according to the present invention has an effect of increasing sales.

Preferably, the protruding portion 112 may be formed in a curve having a specific curvature to provide an excellent external appearance. That is, when the protruding portion 112 is formed in a curve, an external design of the drum washing machine 100 can be improved.

More preferably, when the size of the door 200 is increased, the door 200 is formed toward an upper portion of the front panel 111 and the protruding portion 112 is formed at the upper portion of the front panel 111. As for the reason, since the user's eyes are generally positioned higher than the drum washing machine 100, the user can easily check the inside of the drum 130 through the door 200 by positioning the door 200 toward the upper portion of the front panel 111.

According to the drum washing machine 100 of the present invention, even when the drum 130 has the same size as a drum of another drum washing machine, the door 200 has a much larger size than a door of another drum washing machine. Accordingly, it is necessary to change the gasket 300. That is, a cross-section of the gasket 300 at a position connected to the door 200 should be formed to be larger than a cross-section of the gasket 300 at a position connected to the tub 120.

Hereinafter, the gasket 300 according to the present invention will be described with reference to FIG. 4.

Figure 4:
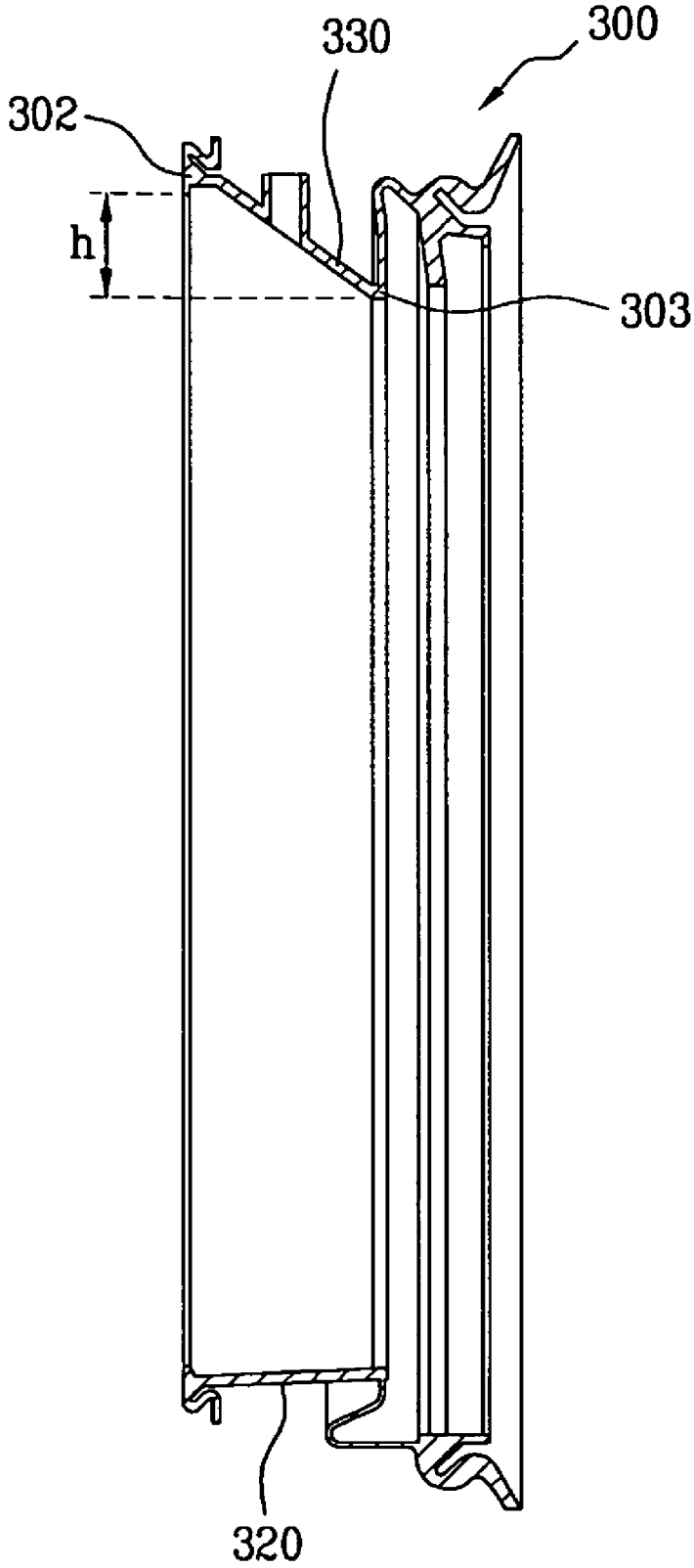
FIG. 4 illustrates a cross-sectional view of a gasket of the drum washing machine according to the present invention.

FIG. 4 illustrates a cross-sectional view of the gasket according to the present invention.

Referring to FIG. 4, the gasket 300 of the drum washing machine 100 according to the embodiment of the present invention includes a first connecting portion 302 which is connected to the loading port formed on the front panel 111 and a second connecting portion 303 which is connected to the loading port formed on the tub 120. The first connecting portion 302 and the second connecting portion 303 are formed in an annular shape, respectively.

That is, the gasket 300 is formed in a cylindrical shape having a length corresponding to a distance between the door 200 and the tub 120, preventing leakage of washing water in the tub 120.

Further, the gasket 300 includes an upper connecting portion 330 which connects upper portions of the tub 120 and the door 200, and a lower connecting portion 320 which connects lower portions of the tub 120 and the door 200.

At least one of the upper connecting portion 330 and the lower connecting portion 320 may be formed to be inclined outwardly in a radial direction toward the first connecting portion 302 at a boundary between the first connecting portion 302 and the second connecting portion 303. That is, preferably, a cross-section of the first connecting portion 302 is formed to be larger as it goes from the tub 120 toward the door 200.

Since the door 200 of the drum washing machine 100 according to the present invention is formed to much larger than the loading port formed on the tub 120, the gasket 300 is formed as described above to be easily connected to the door 200 having a larger size.

That is, as shown in FIG. 4, the gasket 300 according to the present invention is extended by a certain height h on the side of the door 200. Accordingly, the gasket 300 can be more easily connected to the door 200.

Preferably, one of the upper connecting portion 330 and the lower connecting portion 320 is formed to be inclined outwardly in the radial direction toward the door 200, and the other one thereof is formed horizontally. Accordingly, the gasket 300 can be easily connected to the door 200 having a larger size. Also, the gasket 300 can be easily manufactured since it is easier to manufacture the upper connecting portion 330 and the lower connecting portion 320 formed horizontally than to manufacture the upper connecting portion 330 and the lower connecting portion 320 having a certain inclination angle.

More preferably, the upper connecting portion 330 is formed to be inclined outwardly in the radial direction toward the door 200 and the lower connecting portion 320 is formed horizontally. As for the reason, when the size of the door 200 is increased, it is preferable that the door 200 is positioned toward the upper portion of the front panel 111. In this case, the reason for increasing the size of the door 200 and forming the door 200 toward the upper portion of the front panel 111 is the same as described above.

Hereinafter, the door 200 of the drum washing machine 100 according to the present invention will be described in detail with reference to FIGS. 5 to 8.

Figure 5:
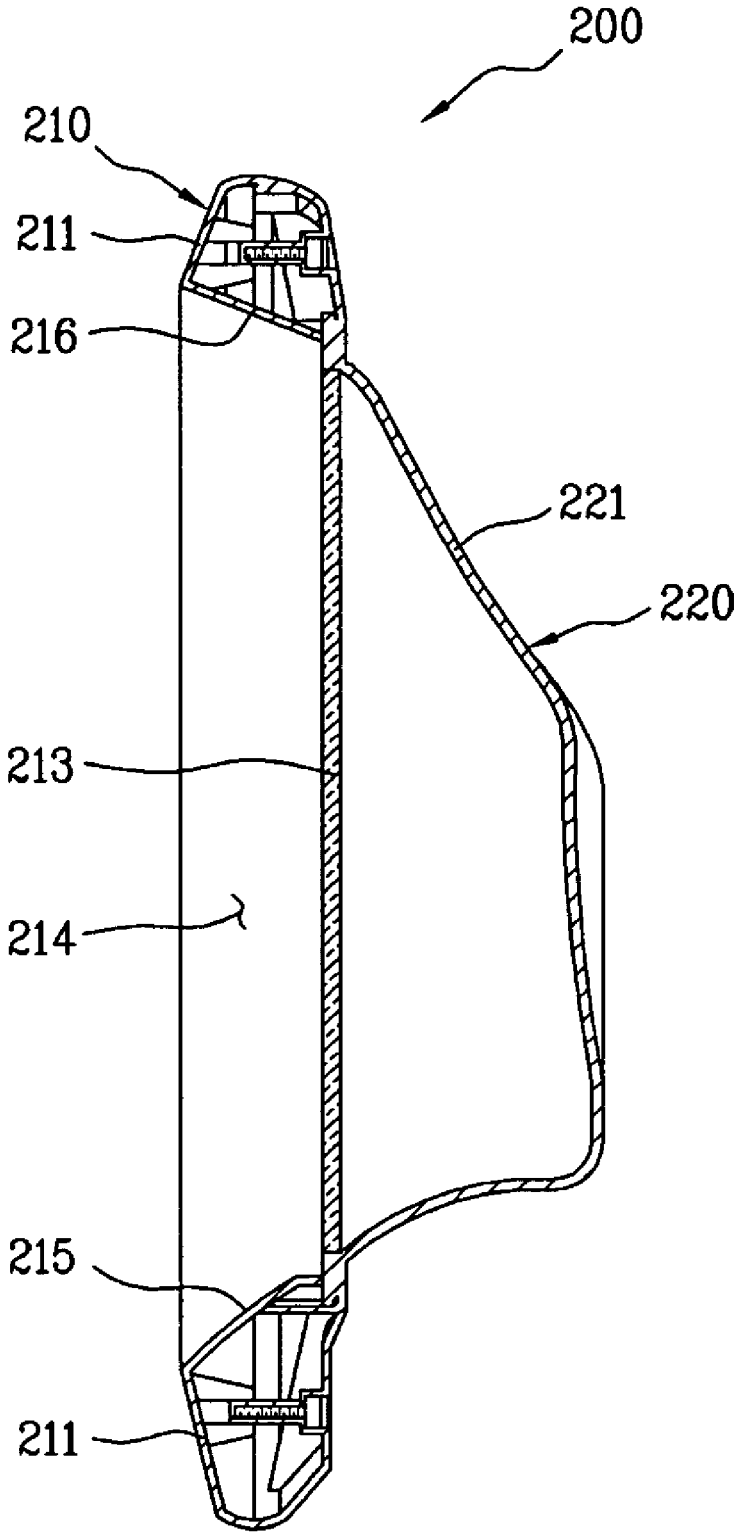
FIG. 5 illustrates a cross-sectional view of the door of the drum washing machine according to the present invention.
Figure 6:
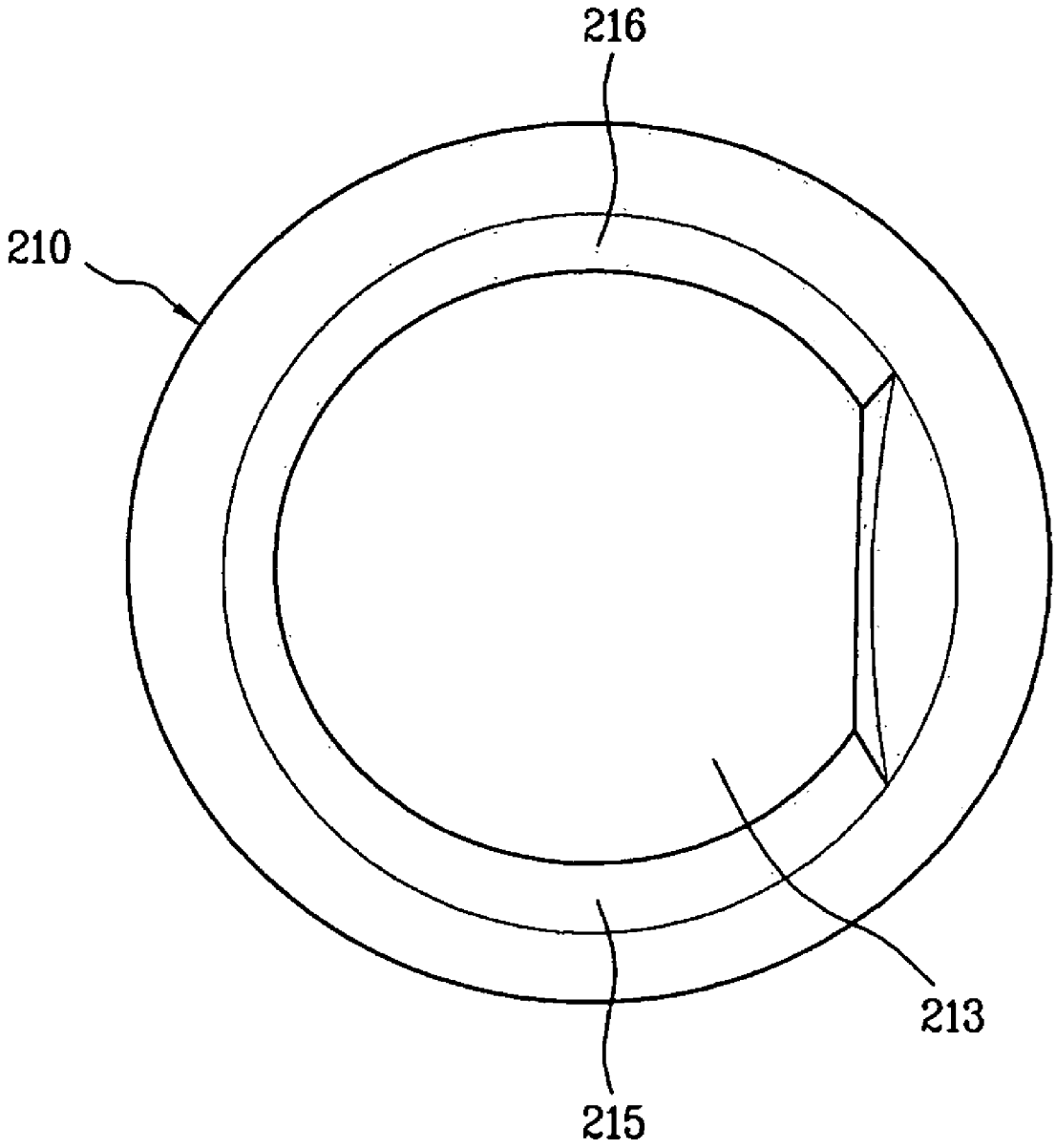
FIG. 6 illustrates a front view of the door shown in FIG. 5.

FIG. 5 illustrates a cross-sectional view of the door according to the present invention. FIG. 6 illustrates a front view of the door.

Referring to FIGS. 5 and 6, the door 200 according to the present invention includes a ring-shaped door frame 210 having an opening 214 formed at a central portion thereof, a door glass 220 which is mounted on the opening 214 and is made of a transparent material, and a door cover 213 which protects the door glass 220 and is made of a transparent material.

Accordingly, the user can check the inside of the drum 130 through the door cover 213 and the door glass 220 even when the door 200 is closed. That is, the user can check the clothes, which are being washed in the drum 130, with his eyes even when the drum washing machine 100 is operated.

In this case, preferably, an upper surface 216 and a lower surface 215 of the opening 214 are inclined such that the size of the opening 214 decreases toward the tub 120.

As for the reason, as the size of the door 200 increases, the opening 214 becomes larger than an opening (not shown) of the tub 120. Accordingly, in order to easily connect the door 200 to the tub 120 via the gasket 300, it is necessary that the size of the opening 214 decreases toward the tub 120.

However, when both the upper surface 216 and the lower surface 215 are formed to be inclined, as shown in FIG. 6, there is a problem that the user can see the upper surface 216 from the outside.

That is, in case where the user can see the upper surface 216 from the outside, it appears that the door 200 is not large. In addition, the user cannot easily check the inside of the drum 130.

Figure 7:
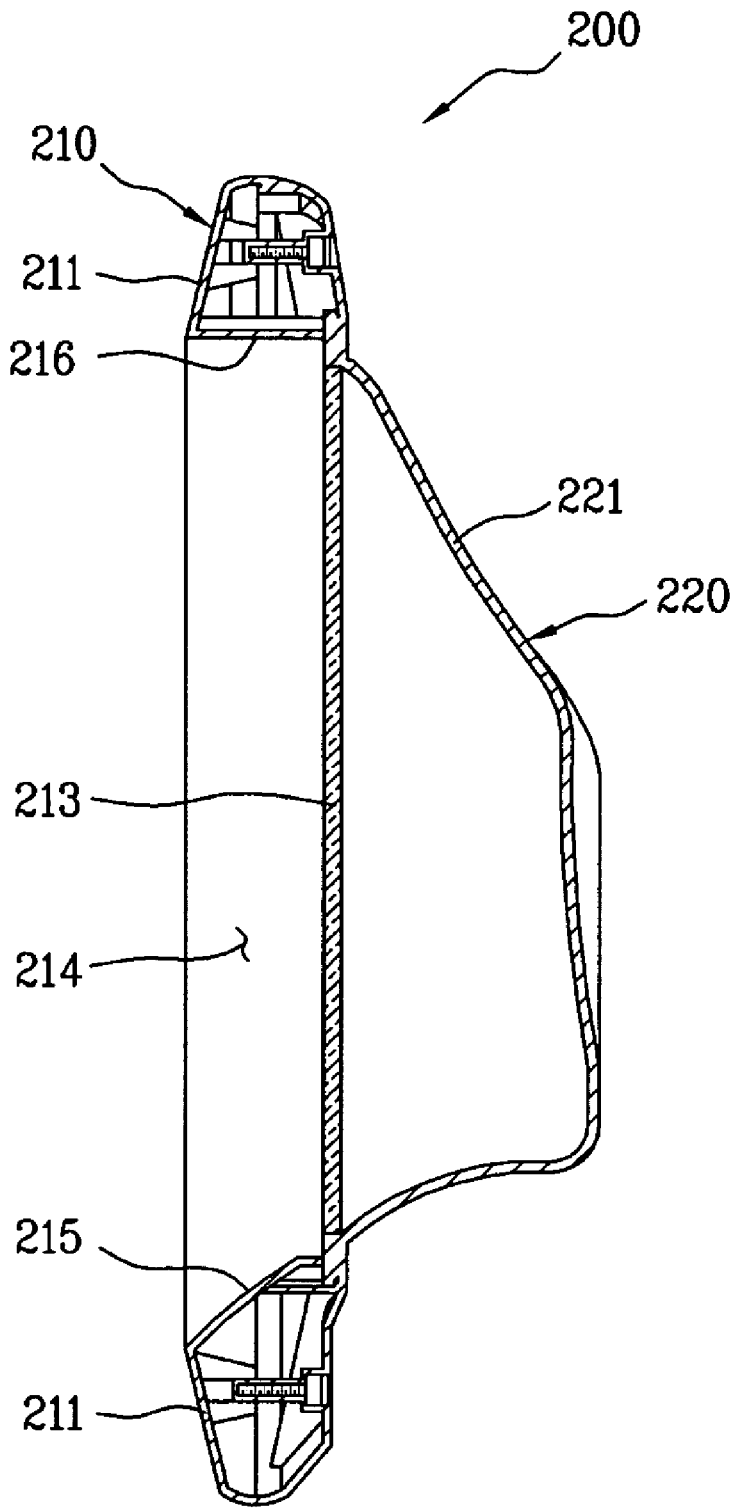
FIG. 7 illustrates a cross-sectional view of a door of a drum washing machine according to another embodiment of the present invention.
Figure 8:
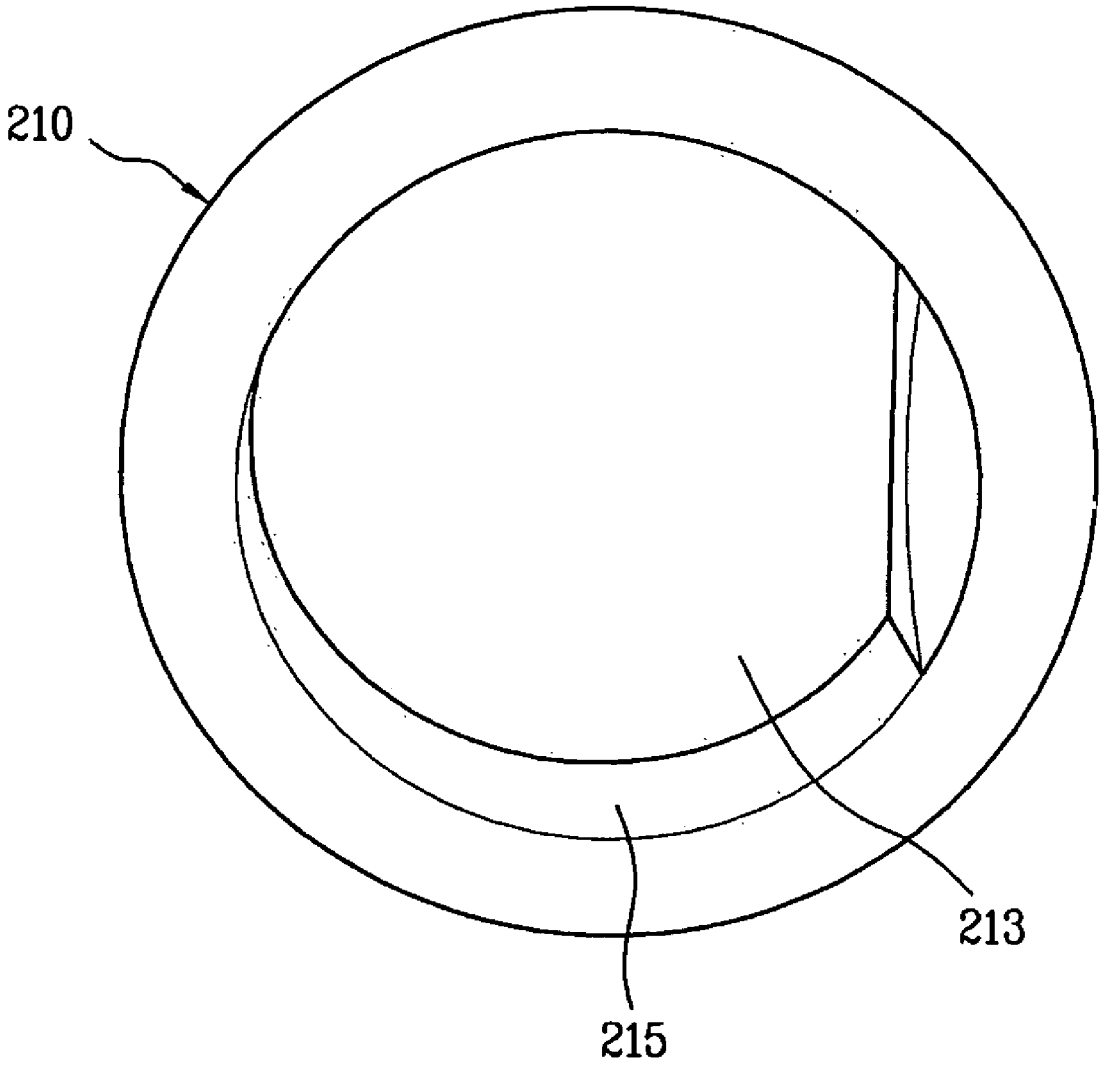
FIG. 8 illustrates a front view of the door shown in FIG. 7.

FIGS. 7 and 8 illustrate the door 200 according to another embodiment of the present invention. This embodiment is different from the above embodiment only in the upper surface 216 and the lower surface 215 of the opening 214 formed on the door 200. The description and reference numerals of other configurations are the same as in the above embodiment.

FIG. 7 illustrates a cross-sectional view of a door according to another embodiment of the present invention.

Referring to FIGS. 7 and 8, in order that the door appears to be large while the size of the door 200 is not changed, the upper surface 216 and the lower surface 215 may be formed to have different inclination angles.

Preferably, at least one of the upper surface 216 and the lower surface 215 of the opening may be formed horizontally. Accordingly, when the user sees the door 200 from the outside, since the upper surface 216 or the lower surface 215 formed horizontally is not seen, even though the size of the door 200 is not changed, the door 200 appears to be large and the user can easily check the inside of the drum 130.

More preferably, the upper surface 216 of the opening is formed horizontally. As for the reason, since the user's eyes are generally positioned higher than the door 200, the user should bend his body to check the inside of the drum 130.

That is, as shown in FIG. 8, if the upper surface 216 of the opening is formed horizontally, the user cannot see the upper surface 216 of the opening from the outside. Accordingly, the door 200 appears to be large, and the user can easily check the inside of the drum 130.

In this case, when the upper surface 216 of the opening is formed horizontally, the upper connecting portion 330 of the gasket 300 is formed to be inclined outwardly in the radial direction toward the door 200.

As for the reason, in case where the upper surface 216 of the opening is formed horizontally, since an upper portion of the opening 214 does not become smaller toward the tub 120, it is necessary that the upper connecting portion 330 is formed to be inclined outwardly in the radial direction toward the door 200 in order to easily connect the gasket 300 to the door 200.

Further, in case where the upper surface 216 of the opening is formed horizontally, preferably, the lower surface 215 of the opening is formed such that the size of the opening 214 decreases toward the drum 130.

As for the reason, since the opening 214 is formed larger than the opening (not shown) of the tub 120, it is necessary that the size of the opening 214 becomes smaller toward the tub 120 in order to easily connect the door 200 and the tub 120 via the gasket 300. Then, the lower connecting portion 320 of the gasket 300 can be formed horizontally.

According to the clothes refreshing apparatus of the present invention, the size of the door can be increased while maintaining the same capacity. Thus, the apparatus appears to be large and the user can easily check the inside of the drum.

Further, even though the size of the door is not changed, the door appears to be large and the user can easily check the inside of the drum.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A clothes refreshing apparatus comprising:

a cabinet which forms an external appearance;

a front panel which forms a front surface of the cabinet and has a loading port through to load clothes;

a drum which is installed in the cabinet and provides a space in which the clothes loaded through the loading port are refreshed;

a door which is installed to selectively open and close the loading port;

a tub which is installed in the cabinet to cover the drum and has a loading port; and a gasket formed in a cylindrical shape, which connects the loading port of the tub to the loading port of the front panel, wherein the door is formed to have a vertical length larger than a vertical length of side surfaces of the front panel and wherein the gasket includes;

a first connecting portion connected to the loading port of the front panel; and a second connecting portion connected to the loading port of the tub; and an upper connecting portion which connects an upper portion of the first connecting portion to an upper portion of the second connecting portion; and a lower connecting portion which connects a lower portion of the first connecting portion to a lower portion of the second connecting portion, and wherein the upper connecting portion is formed to be inclined outwardly in the radial direction toward the door and the lower connecting portion is formed horizontally so as to position a central portion of the door higher than a central portion of the loading port of the tub.

2. The clothes refreshing apparatus according to claim 1, wherein a protruding portion that is protruded upward is formed on at least one side of an upper central portion of the front panel.

3. The clothes refreshing apparatus according to claim 2, wherein the protruding portion is formed in a curve having a specific curvature.

* * * * *